US011642560B1

(12) United States Patent
Hewlett

(10) Patent No.: US 11,642,560 B1
(45) Date of Patent: May 9, 2023

(54) VERTICALLY-MOUNTED MODULAR FITNESS SYSTEM

(71) Applicant: Mark Andrew Hewlett, Pacific Palisades, CA (US)

(72) Inventor: Mark Andrew Hewlett, Pacific Palisades, CA (US)

( * ) Notice: Subject to any disclaimer, the term of this patent is extended or adjusted under 35 U.S.C. 154(b) by 0 days.

(21) Appl. No.: 17/582,818

(22) Filed: Jan. 24, 2022

(51) Int. Cl.
*A63B 17/04* (2006.01)
*A63B 21/16* (2006.01)
*A63B 23/035* (2006.01)

(52) U.S. Cl.
CPC ..... *A63B 17/04* (2013.01); *A63B 21/169* (2015.10); *A63B 23/03558* (2013.01); *A63B 2210/50* (2013.01)

(58) Field of Classification Search
CPC ..... A63B 21/1627; A63B 21/169; A63B 21/1681; A63B 21/1618–1663
See application file for complete search history.

(56) References Cited

U.S. PATENT DOCUMENTS 4,907,798 A * 3/1990 Burchatz ..... A63B 21/154 482/99
5,046,722 A * 9/1991 Antoon ..... A63B 17/00 482/41
5,180,350 A * 1/1993 Thomas ..... A63B 1/00 482/40
5,346,448 A * 9/1994 Sollo ..... A63B 21/00181 482/99
6,267,711 B1 * 7/2001 Hinds ..... A63B 21/1663 482/904
7,699,756 B2 * 4/2010 Piane, Jr. ..... A63B 71/0036 248/222.52
7,850,578 B2 * 12/2010 Balaker ..... A63B 21/4034 482/131
9,308,410 B2 * 4/2016 Beaver ..... A63B 26/00
10,220,235 B2 * 3/2019 Norris ..... A63B 21/153
(Continued)

FOREIGN PATENT DOCUMENTS

DE 102017011727 A1 * 6/2019 ..... A63B 17/04
FR 2717089 A1 * 9/1995 ..... A63B 17/00
GB 2600988 A * 5/2022 ..... A63B 17/00

*Primary Examiner* — Nyca T Nguyen

(57) ABSTRACT

A modular fitness system includes a set of two or more spaced-apart elongate wall bars that are secured to a wall or similar vertical structure at spaced apart locations on the wall and at a substantially vertical orientation. Each wall bar has a linear array of wall through-holes incrementally disposed along the length of the wall bar for attaching the wall bar to the wall. A first set of two or more horizontal elongate bars are installed on top of and orthogonal to the wall bars to form a T with the wall bars. Each of the horizontal elongate bars comprises a first linear array of bar through-holes spaced at increments along a length of the elongate bar that match at least a portion of the linear array of wall through-holes when secured to the wall. The linear arrays of bar through-holes in the horizontal elongate bars, when secured to the set of wall bars, form a rectangular array of equally spaced through-holes in a plane parallel to and offset from the planar surface of the vertical structure. The rectangular array provides locations for attachment of an additional set of elongate bars, one or more components for holding fitness equipment, or both.

22 Claims, 7 Drawing Sheets

(56) References Cited

U.S. PATENT DOCUMENTS

| | | | | |
|---|---|---|---|---|
| 10,946,261 | B2 * | 3/2021 | Arredondo | A63B 69/004 |
| 11,058,936 | B1 * | 7/2021 | Brasch | A63B 21/078 |
| 11,123,595 | B2 * | 9/2021 | Henniger | A63B 21/068 |
| 11,260,261 | B2 * | 3/2022 | Henniger | A63B 21/062 |
| 2002/0123415 | A1 * | 9/2002 | Marques | A63B 17/00 482/904 |
| 2012/0094815 | A1 * | 4/2012 | Trettin | A63B 23/0205 482/143 |
| 2014/0148318 | A1 * | 5/2014 | Sanders | A63B 21/4023 482/131 |
| 2016/0175653 | A1 * | 6/2016 | Beaver | B65D 88/02 482/92 |
| 2016/0256723 | A1 * | 9/2016 | Intlekofer | A63B 21/1627 |
| 2017/0056702 | A1 * | 3/2017 | Carter | A63B 21/0442 |
| 2017/0182349 | A1 * | 6/2017 | DiMartino | A63B 21/0442 |
| 2018/0178051 | A1 * | 6/2018 | Shaw, Jr. | A63B 21/078 |
| 2018/0290042 | A1 * | 10/2018 | Vester | A63B 71/023 |
| 2020/0230458 | A1 * | 7/2020 | Dery | B60P 3/1008 |
| 2020/0384337 | A1 * | 12/2020 | Brasch | A63B 21/078 |
| 2021/0170218 | A1 * | 6/2021 | Lewis-Dove | A63B 21/06 |

* cited by examiner

VERTICALLY-MOUNTED MODULAR FITNESS SYSTEM

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

Home gyms and related exercise/fitness equipment have increased in popularity over the recent years. However, existing gym equipment and/or fitness equipment tend to be bulky, cumbersome, and unaesthetic. Because the room or area the equipment occupies may vary greatly with respect to size, shape and function, the existing equipment generally being "one size fits all" will typically have a negative impact on the flow and/or aesthetics of the room, while inefficiently occupying the space in which the equipment is placed.

Accordingly, an object of the presented technology is a vertically-mounted modular fitness system that provides an aesthetically pleasing platform, and is customizable to the space being occupied and adaptable to the equipment being used as well as the end user that is using it.

SUMMARY OF THE DISCLOSURE

The technology of the present description is directed to a vertically-mounted fitness system that is modular and customizable to its environment and the user's needs.

In one aspect, the modular fitness system includes a set of two or more spaced-apart elongate wall bars that are secured to a vertical structure, such as a wall, at spaced apart locations on the vertical structure and at a substantially vertical orientation on one or more planar surfaces of the vertical structure. Each wall bar has a linear array of wall through-holes incrementally disposed along the length of the wall bar for attaching the wall bar to the vertical structure via a fastener. A first set of two or more horizontal elongate bars are installed on top of and orthogonal to the wall bars to form a T with the wall bars. Each of the horizontal elongate bars comprises a first linear array of bar through-holes spaced at increments along a length of the elongate bar that match at least a portion of the linear array of wall through-holes when secured to the vertical structure. The linear arrays of bar through-holes in the horizontal elongate bars, when secured to the set of wall bars, form a rectangular array of equally spaced through-holes in a plane parallel to and offset from the planar surface of the vertical structure. The first rectangular array has individual through-hole axes perpendicular to the mounting surface, and provide locations for attachment of an additional set of elongate bars, one or more components for holding fitness equipment, or both.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

FIG. 1 through FIG. 4G illustrate an embodiment of a vertically-mounted modular fitness system 10 and method for holding and storing physical fitness equipment in accordance with the technology of the present description. Because the modular fitness system 10 is modular and customizable to an infinite number of configurations, it is appreciated that FIG. 1 through FIG. 4G show an exemplary configuration from among numerous possible configurations and forms of the system 10 according to the user's taste and the room and/or area or environment the system is being mounted.

In most cases, the modular fitness system 10 will be generally mounted to a wall of a room. However, the embodied configuration shown in FIG. 1 through FIG. 4G may be mounted on any vertical structure. For example, the modular fitness system 10 may be mounted on two or more spaced-apart posts, poles columns or like vertical structures that have at least one end anchored or otherwise fixed to the ground and are parallel with respect to each-other so as to substantially coincide in the same plane, which are collectively referred to as a "mounting surface" or "planar surface." Thus, the modular fitness system 10 may be installed and used in nearly any indoor or outdoor location.

Figure 1:
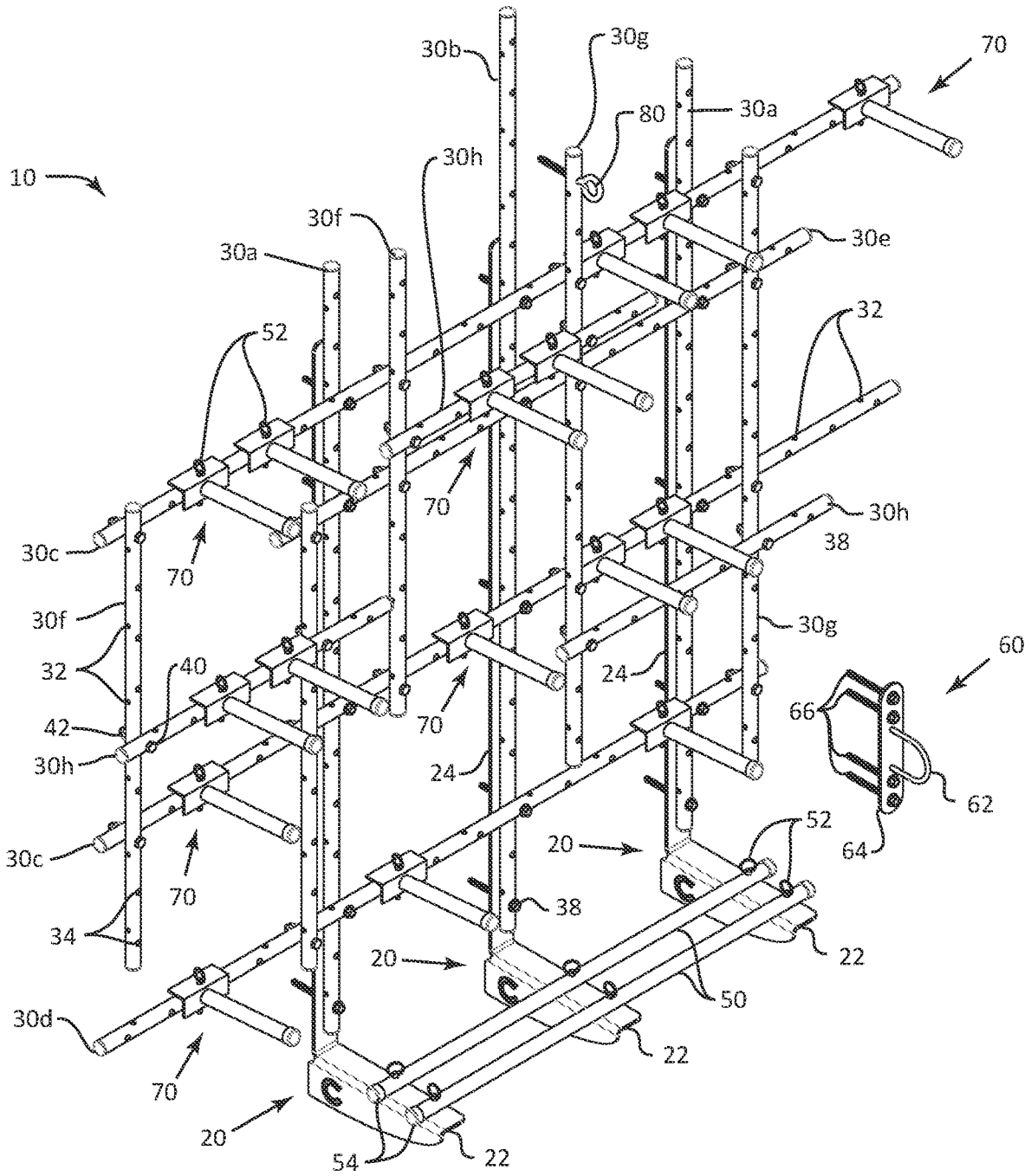
FIG. 1 is a perspective view of a vertically-mounted modular fitness system in accordance with the present disclosure.

Referring now to FIG. 1, a perspective view is provided of the vertically-mounted modular fitness system 10 in a fully assembled configuration. The base of the modular fitness system 10 is a set of elongate L-shaped wall plates or bars, hereinafter referred to as wall bars 20 that attach at spaced-apart locations to a vertical structure, such as a wall. While three wall bars 20 are shown in the configuration of the modular fitness system 10 FIG. 1 through FIG. 4G, it is appreciated that any number of wall bars, e.g. from to 2 to n, may be employed according to the space or platform desired by the user. A first set of three vertical elongate bars 30*a*/30*b* are positioned adjacent and in-line with respective vertical columns or wall plates 24 of wall bars 20 opposite from surface of the wall (or vertical mounting structure) and providing additional standoff from the wall. A first set of four horizontal elongate bars 30*c*/30*d*/30*e* are located at spaced apart locations on the set of three vertical elongate bars 30*a*/30*b*. A second set of five vertical elongate bars 30*f*/30*g* are located at spaced apart locations on the first set of four horizontal elongate bars 30*c*/30*d*/30*e*. A second set of three horizontal elongate bars 30*h* are located at spaced apart locations on the second set of five vertical elongate bars 30*f*/30*g*. For purposes of this discussion, "horizontal" and "vertical" as applied to the elongate bars 30*a* through 30*h* is merely meant to detail the mounting orientation of the bar, as any elongate bar may be mounted vertically or horizontally.

Each of the elongate bars 30*a* through 30*h* may vary by one or more of number, size, shape, color and orientation with respect to a given system 10 and each other. For example, in the embodiment of the system 10 illustrated in FIG. 1 through FIG. 4G, elongate bars 30*h* are 2 ft in length, elongate bars 30*f* are 3 ft in length, elongate bars 30*e* and 30*g* are 4 ft in length, elongate bars 30*a* and 30*d* are 5 ft in length, and elongate bars 30*b* and 30*c* are 6 ft in length. Differing, lengths, set sizes or combinations thereof or contemplated.

Additionally, elongate bars 30*a* through 30*h* the embodiment of the system 10 illustrated in FIG. 1 through FIG. 4G generally comprise aluminum tubular rods having a circular cross-section. However, elongate bars 30*a* through 30*h* may variably comprise other shapes (e.g. rectangular) and differing materials (e.g. steel, titanium, composite materials, etc.).

Furthermore, one or more of the elongate bars 30*a* through 30*h* may vary in color. For example, some or all of the bars may comprise a first color, and some or all of the bars may comprise a second color, third color, etc. Color selection may be achieved with paint or other coating/layering process (e.g. powder coating, anodizing, etc).

Figure 2B:
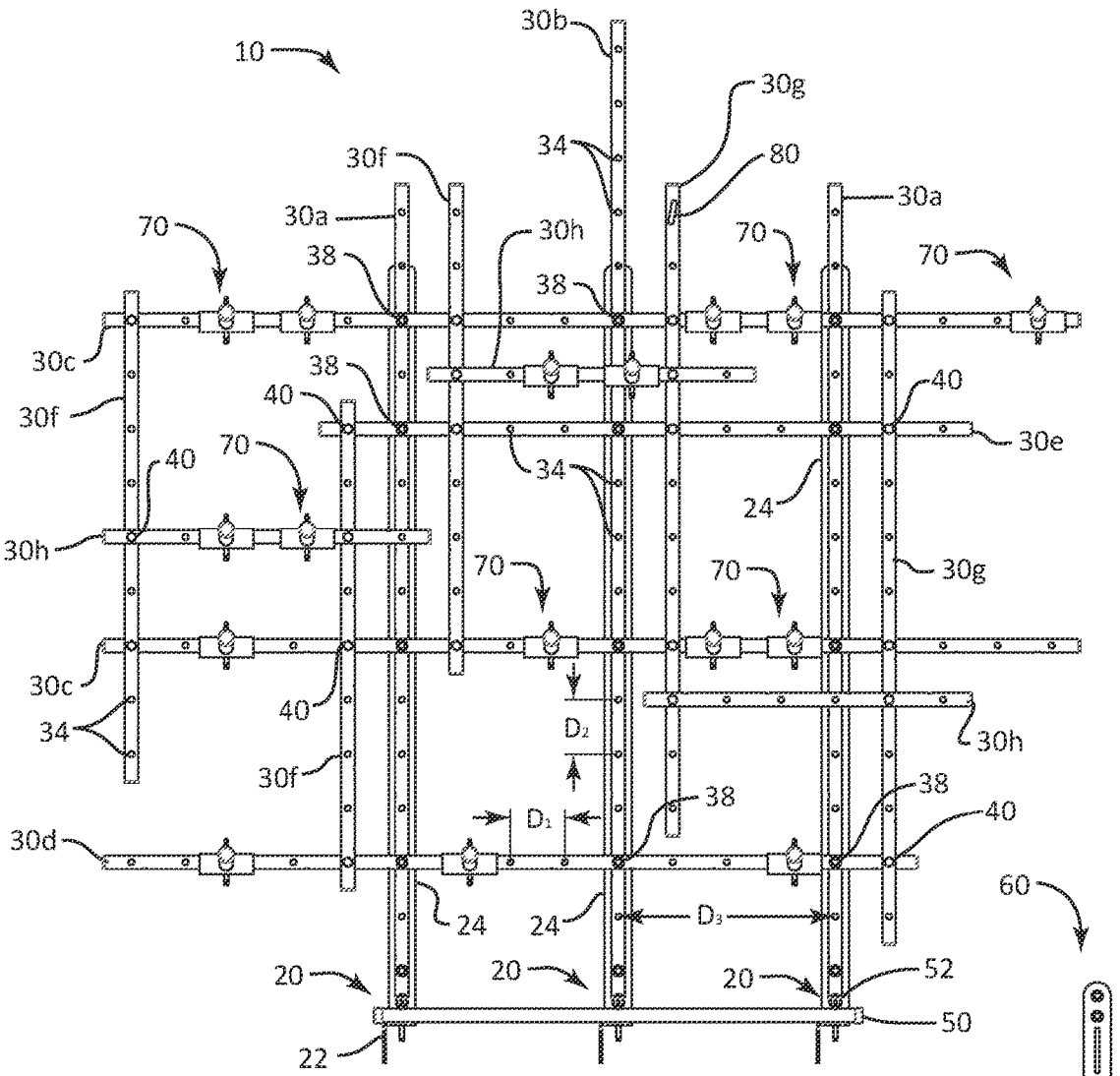
FIG. 2B is a front view of the modular fitness system of FIG. 1.
Figure 2A:
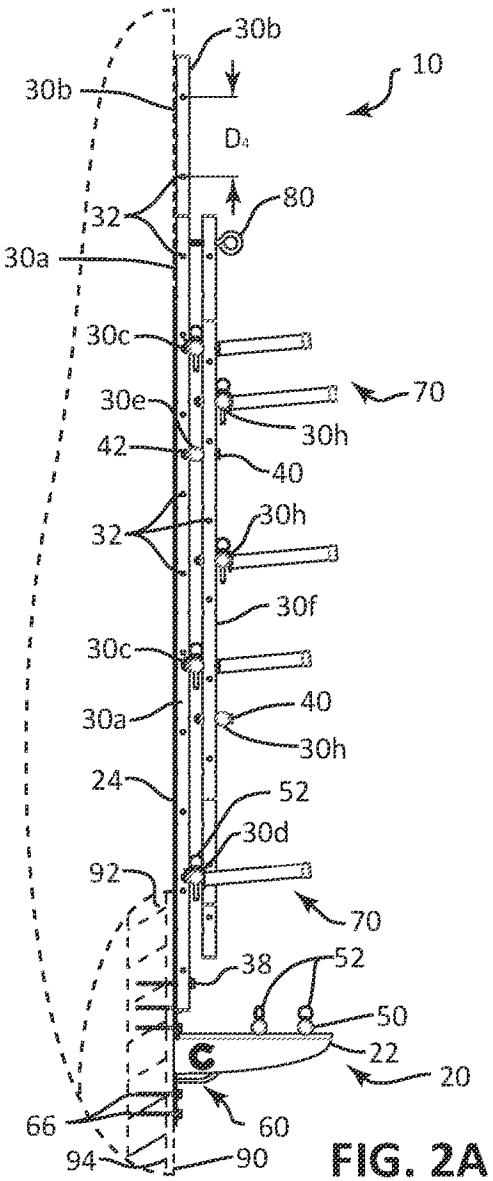
FIG. 2A is a side view of the modular fitness system of FIG. 1 being mounted to a wall.

FIG. 2A is a side view of the modular fitness system of FIG. 1 being mounted to a vertical structure, in particular an indoor wall 90. Additional stand alone components, e.g. battle rope bracket 60, may also be fastened to the vertical structure. In this configuration, the system 10 and battle rope bracket 60 are secured to the wall 90 via fastening through a minimally supportive wall layer 94, (typically drywall, i.e., gypsum board, Sheetrock®, etc.) and into one or more supportive structural elements 92 of the wall 90 (e.g. wooden studs 92) via respective screw anchors 38/66. In one embodiment, screw anchors comprise wood screws (e.g. hex head wood screws, size M10×100 mm).

It is appreciated that the system 10 may be installed into a number of differing structures or wall types, and thus fasteners 38 may comprise any number of differing types of fasteners available in the art, (e.g. concrete or masonry screws, lag screws, carriage bolts, etc.). In addition, where a rigid backing such as a stud 92 is not available for one or more mounts, additional fastening means (e.g. drywall anchors or the like) may also be employed.

Referring to FIG. 2A and FIG. 2B, the elongate bars 30*a* through 30*h* and wall bars 20 all comprise one or more sets of linear arrays of through-holes for mounting/fastening various elongate bars to each-other and other components (e.g. holding bar assemblies 70, dumbbell support bars 50, eye bolt 80, etc.) to the modular fitness system 10. Mounting may be achieved via various fasteners, e.g. screws/anchors 38, nuts/bolts 40/42, eye-ring quick release fasteners 52 or the like). In particular, elongate bars 30*a* through 30*h* comprise a first linear array of bar through-holes 34 (see FIG. 2B) spaced at equal increments along the length or axis of the elongate bars. In one embodiment, each of the elongate bars 30*a* through 30*h* further comprise a second linear array of bar through-holes 32 (see FIG. 2A) that are radially offset (e.g. radially orthogonal) to the first linear array of bar through-holes 34. Additionally, the first linear array of holes 34 may optionally be linearly offset or staggered with respect to the second linear array of holes 32 along the axis of the elongate bars 30*a* through 30*h*. This configuration allows for some of the bar through-holes (e.g. first linear array of through holes 34 in FIG. 2B) to be in a planar array having individual through-hole axes perpendicular to the vertical structure mounting surface, such as for mounting the elongate bars 30*a* through 30*h* to the vertical structure or wall 90, elongate bars 30*a* through 30*h* to each other, or eye-bolt 80. The second array of through-holes 32, being orthogonal to the first array of through holes 34, are thus disposed with individual through-hole axes in a plane parallel to the mounting surface of the vertical structure 90, and may be used for mounting one or more components of the fitness system (e.g. holding bar 70.)

As best illustrated in FIG. 2B, the bar through-holes 34 from each set of spaced apart elongate bars (e.g. first set of vertical elongate bars 30*a*/30*b*, second set of vertical elongate bars 30*f*/30*g*, first set of four horizontal elongate bars 30*c*/30*d*/30*e*, or second set of three horizontal elongate bars 30*h*) forms a rectangular array of holes in the respective mounting planes of the set of elongate bars (all planes generally being parallel to the mounting surface of the vertical structure being attached to). In one embodiment, the through holes 32/34 have a uniform spacing $D_1$, $D_2$ that promotes mounting of the wall bars 20 to the appropriate structural elements. For example, wall studs 92 typically have a spacing of 16" or 24" (center to center). Thus, to maximize compatibility, the length of spacing $D_1$, $D_2$ (spacing for holes 34) ideally are divisible into both 16 and 24, e.g. 1", 2", 4", 8", etc. The exemplary configuration shown in FIG. 2A and FIG. 2B details a mounting configuration having a distance $D_3$ between wall bars 20 of $4\times D_1$, with $D_1=D_2=4"$, $D_3=16"$, and $D_4=8"$ (spacing for through holes 32). The holes 32/34 may also be spaced according to different standards (e.g. 400 mm/600 mm spacing).

The configuration detailed in FIG. 1 through FIG. 4G shows four sets of orthogonally mounted bars to form a number of rectangular arrays of bar through-holes 34. However, it is appreciated that in a simplified variation, as little as two sets (e.g. first set of vertical elongate bars 30*a*/30*b* and first set of four horizontal elongate bars 30*c*/30*d*/30*e*) may be used to form the array.

Figure 4B:
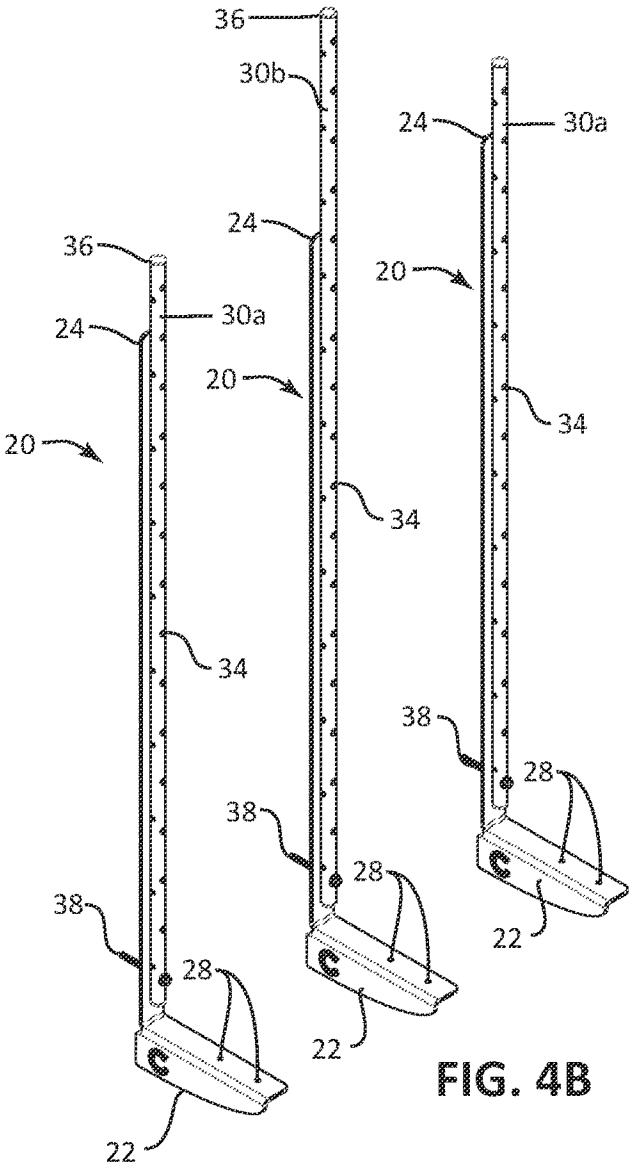
FIG. 4B shows perspective view illustrating a second step of mounting the L-shaped wall bars along with a first set of vertical elongate bars at the spaced-apart locations.

The rectangular arrays of bar through-holes 34, and manipulability thereof, provide a unique and robust variability in placement and arrangement of the elongate bars 30*a* through 30*h* with respect to each other and the vertical mounting structure. Along with the variability of the length, color, and shape of the elongate bars 30*a* through 30*h*, the modular fitness system 10 is provided with considerable flexibility with respect to overall shape, size and function to adapt and/or accommodate varying vertical mounting structures (e.g. wall 90) and the associated room or environment. This flexibility and variability, along with the method of installation detailed further in FIG. 4A thorough FIG. 4G, provides the user with the ability to mold the modular fitness system 10 to their particular home environment, their fitness routine and their personal tastes, creating an artistic element to what traditionally is a solely utilitarian structure or process in conventional fitness systems.

Figure 3A:
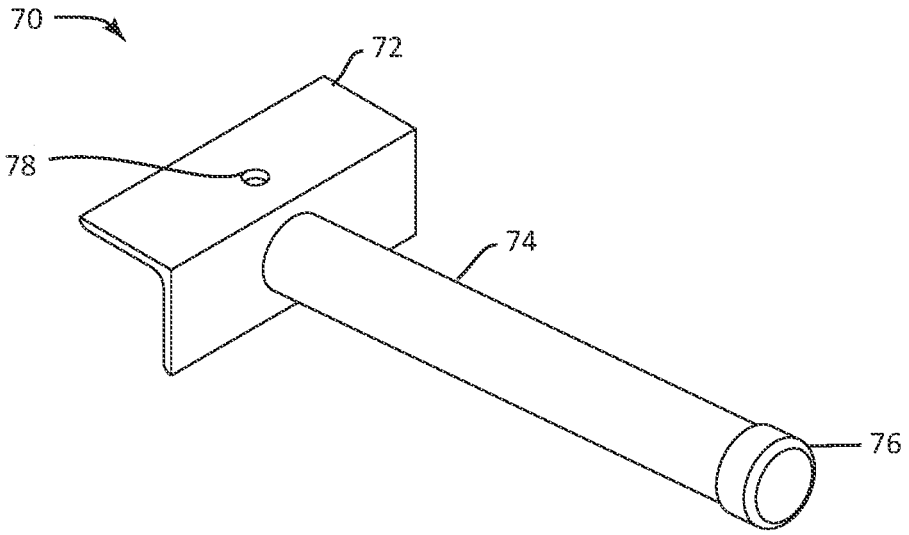
FIG. 3A is a perspective view of a holding bar assembly as detailed in FIG. 1.
Figure 3B:
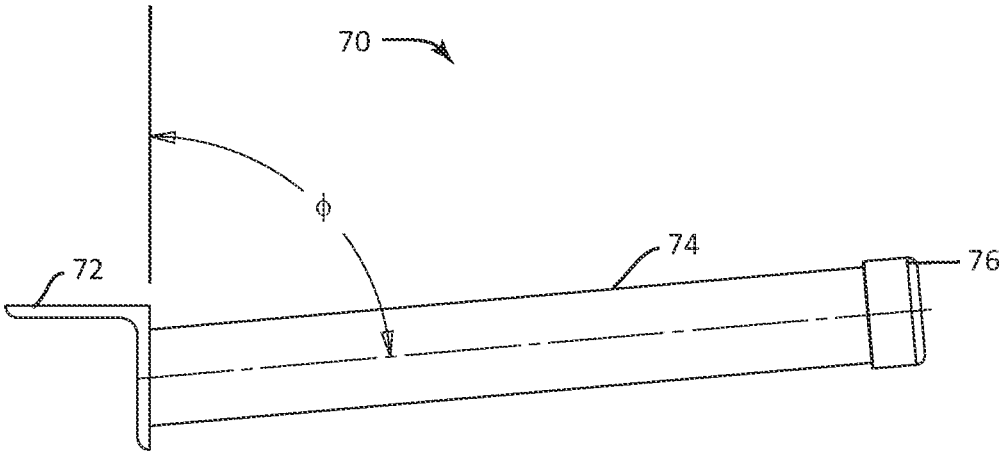
FIG. 3B is a side view of the holding bar assembly of FIG. 1.

FIG. 3A and FIG. 3B are detailed perspective views of a peg/pin-retained holding bar, referred hereafter to as holding bar assembly 70, which is configured to releasably and variably attach to any of the elongate bars 30*a* through 30*h* for retention of one or more fitness devices or components.

The holding bar assembly 70 generally comprises a cylindrical bar or rod 74 having a proximal end attached to and projecting from an L-shaped bracket 72. The distal end of the rod 74 may comprise a cap 76, preferably comprising a soft material such as a polymer or plastic (e.g. vinyl). L-shaped bracket 72 is sized and shaped to rest on and be retained by one or more of the elongate bars 30*a* through 30*h*, in particular by fastening the holding bar assembly 70 via a pin (e.g. ring-grip quick release pin 52 or like fastener) through a flange through-hole 78 in the upper (horizontal) flange of the L-shaped bracket 72 and a through-hole 32/34 of the elongate bar when the upper flange of the L-shaped bracket 72 is resting on the elongate bar.

The rod 74 projects from a side (vertical) flange of the L-shaped bracket 72 at an angle $\phi$. Ideally, the angle $\phi$ (angle between the rod 74 axis and side flange) is such that the rod 74 has at least a level or slightly upward slope from the bracket flange to the distal end of the rod 74. The upward slope allows for certain fitness items (e.g. medicine ball, etc.) to be retained on the rod 74 without inadvertently rolling or sliding off. In one exemplary embodiment, the holding bar assembly 70 comprises a metallic 1" round tube of 9" length, welded at an angle $\phi$=85° to a 4" long L-shaped bracket 72.

It is appreciated that the shape and dimensions of the holding bar assembly 70 may vary. For example, the rod 74 may have a rectangular cross-section, and/or be curved or have an L-shape to provide the retention functionality discussed above. Furthermore, the holding bar assemblies 70 shown in FIG. 1 through FIG. 4G are configured and illustrated for attachment to horizontal elongate bars (e.g. 30*c*, 30*d*, 30*e* and 30*h*). However, in one embodiment (not shown), holding bar assemblies 70 could be configured for mounting to vertical elongate bars (e.g. 30*a*, 30*b*, 30*f*, and 30*g*) via a c-shaped bracket 72.

FIG. 4A through FIG. 4G show a method of installing the modular fitness system 10 and holding and storing physical fitness equipment. While the process steps detailed in FIG. 4A through FIG. 4G are exemplary of one method of installation, it is appreciated that the modular fitness system 10 may be performed in various ways according to the implementation desired by the end user.

Figure 4A:
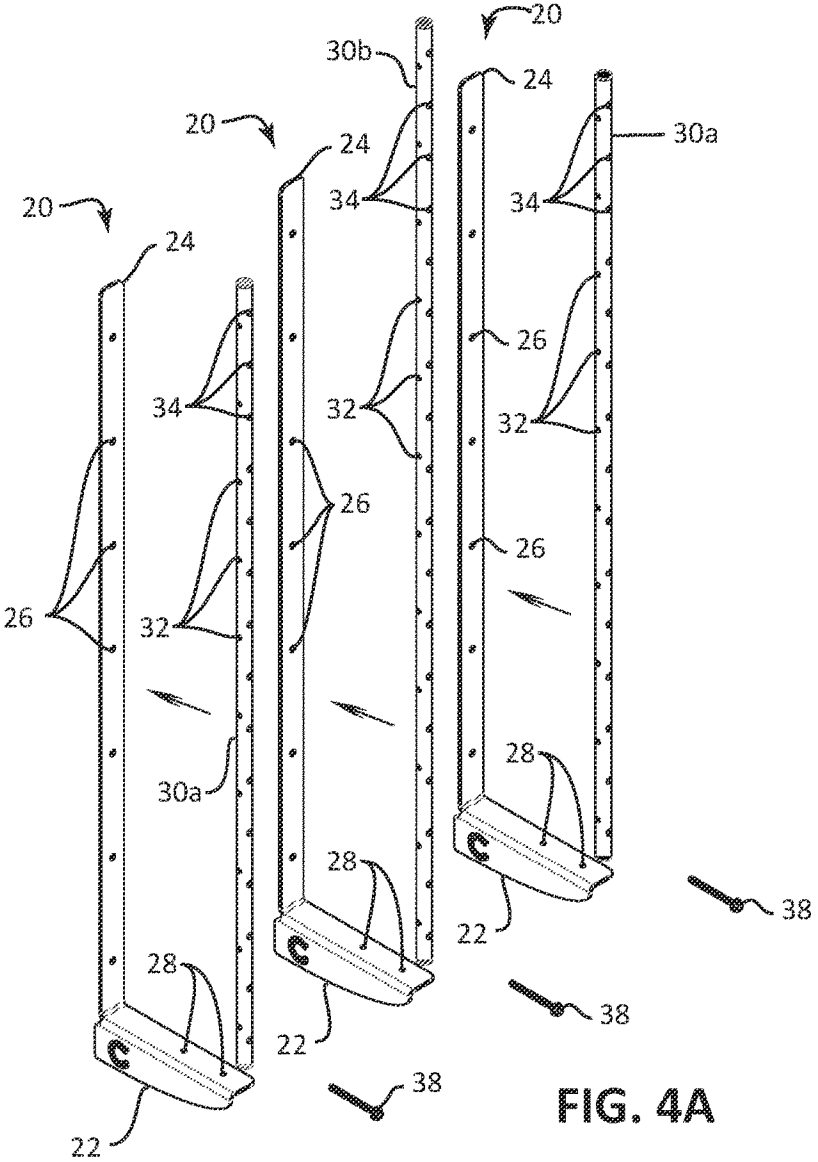
FIG. 4A shows perspective view illustrating a first step in mounting the modular fitness system of FIG. 1, the first step involving positioning a plurality of L-shaped wall bars at spaced-apart locations on a vertical structure such as a wall.
Figure 4D:
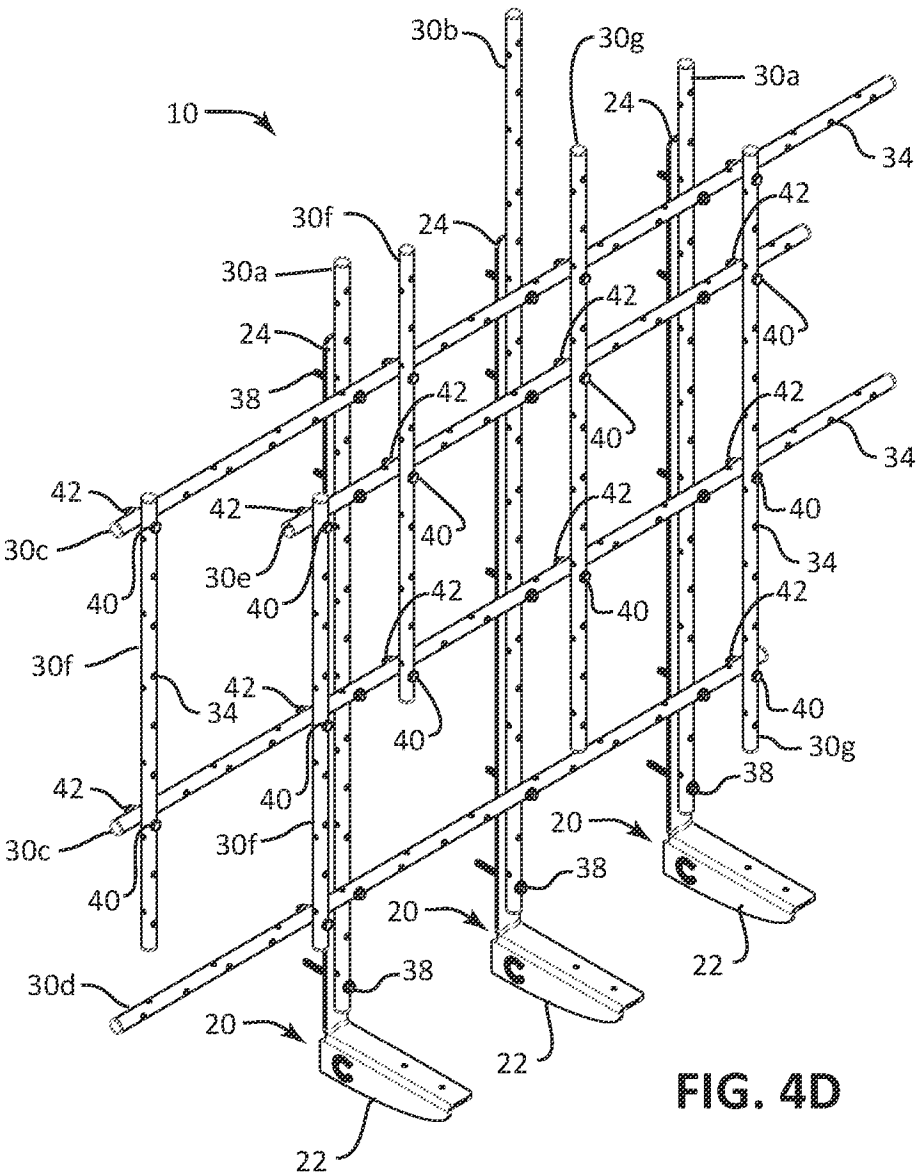
FIG. 4D shows perspective view illustrating a fourth step of mounting a second set of vertical elongate bars to the first set of horizontal elongate bars.

FIG. 4A shows perspective view illustrating a first step in mounting the modular fitness system 10 of FIG. 1. The first step involves locating the desired overall orientation of the modular fitness system 10 and positioning a plurality of L-shaped wall bars 20 at spaced-apart locations on the vertical structure (e.g. wall 90). Each wall L-shaped wall bar 20 comprises an elongate wall plate 24 having a linear array of wall through-holes 26 incrementally disposed along the length of the plate 24, and a foot plate 22 projecting outward from the wall plate 24. Foot plate 22 comprises a pair of foot through-holes 28. In one embodiment, foot plate 22 has an L-shaped cross-section to provide a more robust bending moment to withstand loading applied to the foot plate 22. For applications on wall structures comprising drywall or like minimally supportive elements, this will typically involve locating dedicated wall studs 92 (see FIG. 2A) and aligning the wall through-holes 26 of each wall plate 24 substantially with the centerline of the stud 92. In general, the wall plates 24 will be substantially vertical along the plane of the wall 90 and thus parallel to each other and level to each other with respect to the ground.

While the embodiments of FIG. 1 through FIG. 4G show a separable wall bar 20 and elongate bars 30*a*, 30*b*, it is appreciated that these elements may be integrated, for example by merely providing a thicker or tubular/rectangular wall plate 24 and or wall through-hole pattern 26 matching that of bar through-holes 34 in elongate bars 30*a*, 30*b*. While such configuration does limit some of the flexibility provided by the variable elongate bar length, it may provide ease in installation or production.

As shown in FIG. 4B, a second step involves mounting or fastening the L-shaped wall bars 20, along with a first set of vertically-oriented elongate bars 30*a*, 30*b*, at the specified spaced-apart locations via fastener 38. Fastener 38 (e.g. wood screw) passes through a bar through-hole 34 in the elongate bars 30*a*, 30*b* and wall through-holes 26 of each wall plate 24. Wall through-holes 26 and bar through-holes 34 are spaced so that wall through-holes 26 match with at least some of the bar through-holes 34 when at least one wall through-hole 26 is concentrically aligned with another bar through-hole 34. A rectangular array (or grid) of through-holes 34 is provided by the conformal spacing and orientation/mounting of set of elongate bars 30*a*, 30*b*.

In one embodiment, elongate bars 30*a*, 30*b* (as well as remaining other elongate bars 30*c*-30*h* to be attached) comprise round circular 1" aluminum tubing (0.12" wall thickness), having 4" (through-holes 34) and 8" (through-holes 32) spacing, with polymeric snap-in round plugs or end caps 36. In a further embodiment, each wall plate 24 comprises a 0.2" thick aluminum plate that is 2" in width and 56" in length, which is welded to an L-shaped foot plate 22 being 12" in length. In another embodiment, all plate 24 is bent to form foot plate 22. Additional support elements (e.g. gusset—not shown) may be provided between the foot plate 22 and wall plate 24.

Figure 4C:
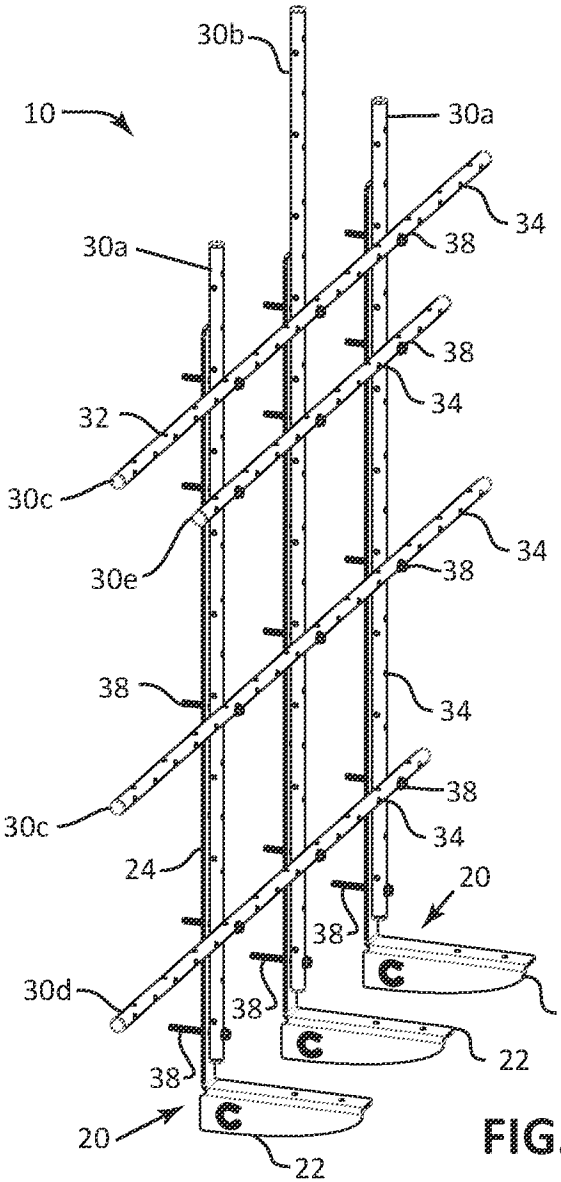
FIG. 4C shows perspective view illustrating a third step of mounting a first set of horizontal elongate bars to the first set of vertical elongate bars.
Figure 4F:
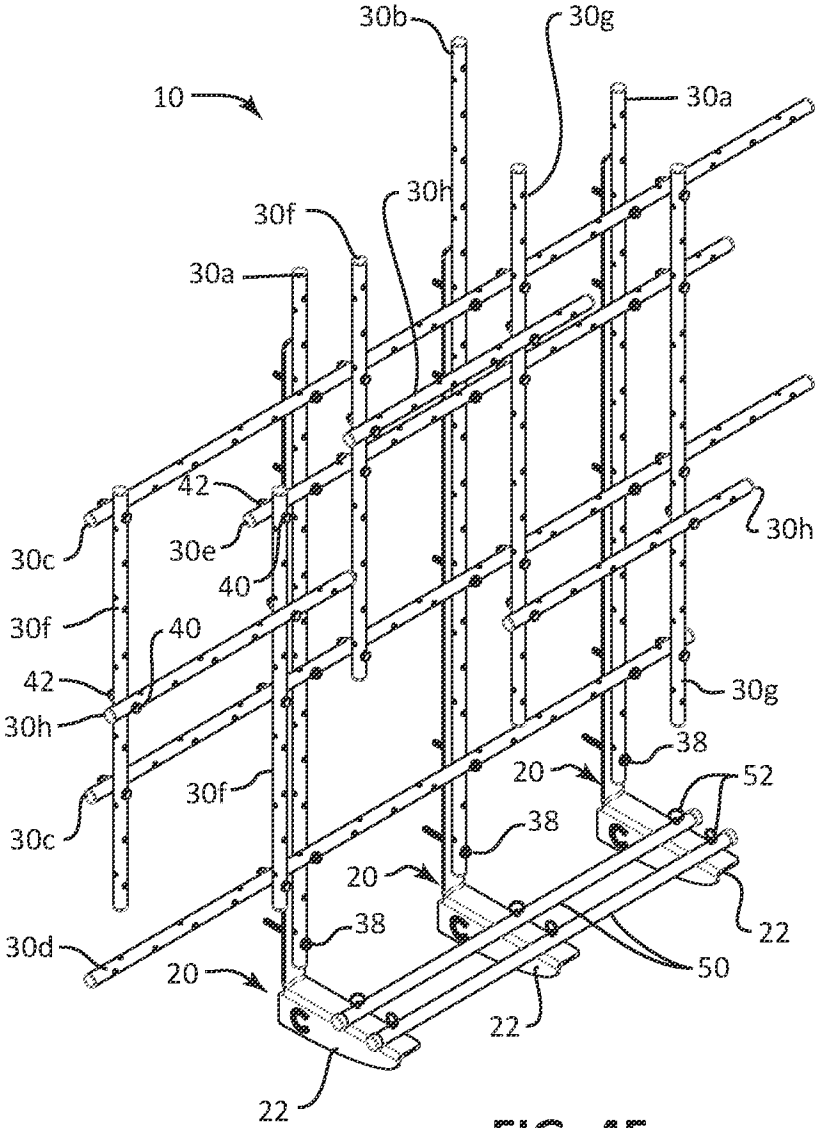
FIG. 4F shows perspective view illustrating a sixth step of mounting a pair of dumbbell support bars to the L-shaped wall bars.

FIG. 4C illustrates a perspective view of a third step of mounting a first set of horizontal elongate bars 30*c*, 30*d* and 30*e* in an orthogonal orientation to the first set of vertical elongate bars 30*a*, 30*b* to form a "T" or cross with vertical elongate bars 30*a*, 30*b* and/or wall bars 20. Additional fasteners 38 are employed at each junction of the crossing elongate bars and through a through-hole 34 in the horizontal elongate bars 30*c*, 30*d* and 30*e*, vertical elongate bars 30*a*, 30*b* and corresponding wall through-hole 26 of each wall plate 24. A rectangular array (or grid) of bar through-holes 34 is provided by the conformal spacing and orientation/mounting of elongate bars 30*c*, 30*d* and 30*e*, the array of through-holes from elongate bars 30*c*, 30*d* and 30*e* being in a plane parallel to and at a distance offset from the plane of array of through-holes from elongate bars 30*a*, 30*b*.

FIG. 4D illustrates a perspective view of a fourth step of mounting a second set of vertical elongate bars 30*f*, 30*g* in an orthogonal orientation to the first set of horizontal elongate bars 30*c*, 30*d* and 30*e*. Fasteners in the form of bolt 40 and nut 42 are employed at each junction of the crossing elongate bars. A rectangular array (or grid) of mounding through-holes 34 is provided by the conformal spacing and orientation/mounting of vertical elongate bars 30*f*, 30*g*, the array of through-holes from elongate bars 30*f*, 30*g* being in a plane parallel to and at a distance offset from the plane of array of through-holes from elongate bars 30*c*, 30*d*, 30*e* and the plane of array of through-holes from elongate bars 30*a*, 30*b*.

Figure 4E:
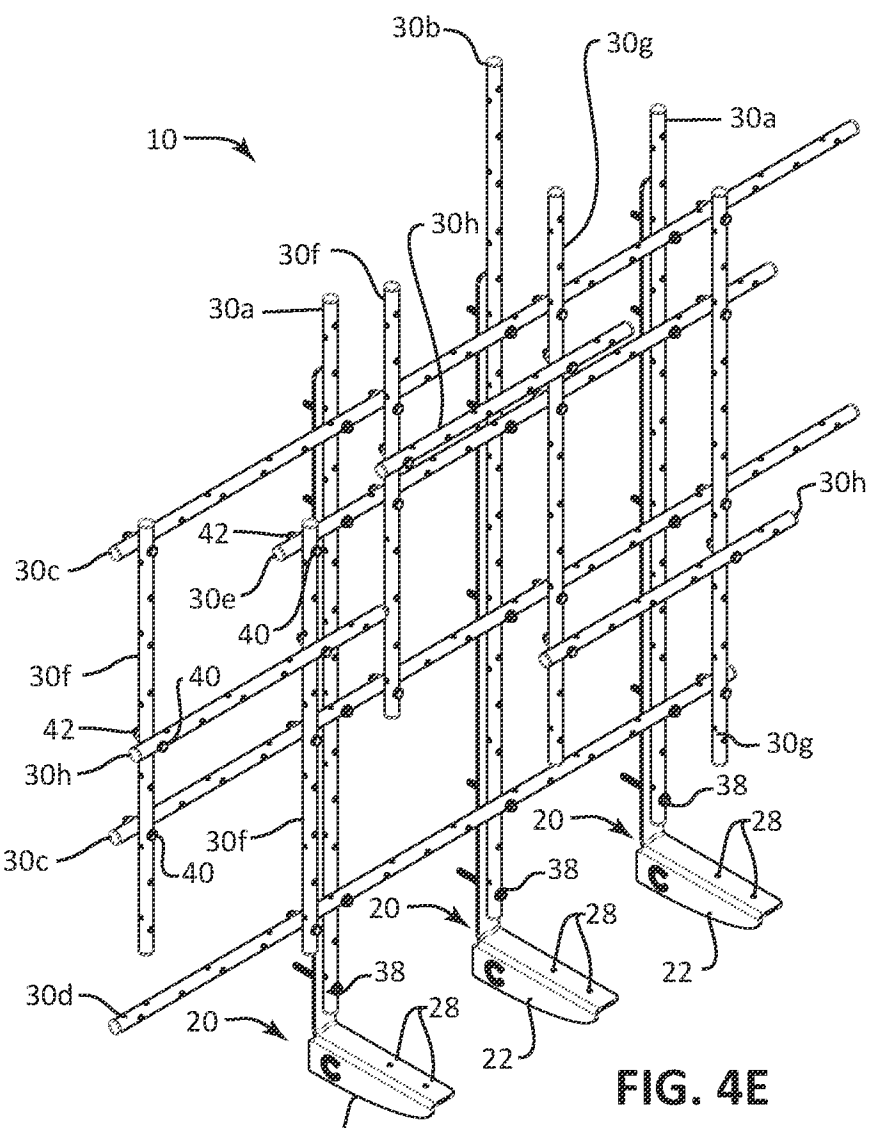
FIG. 4E shows perspective view illustrating a fifth step of mounting a second set of horizontal elongate bars to the second set of vertical elongate bars.
Figure 4G:
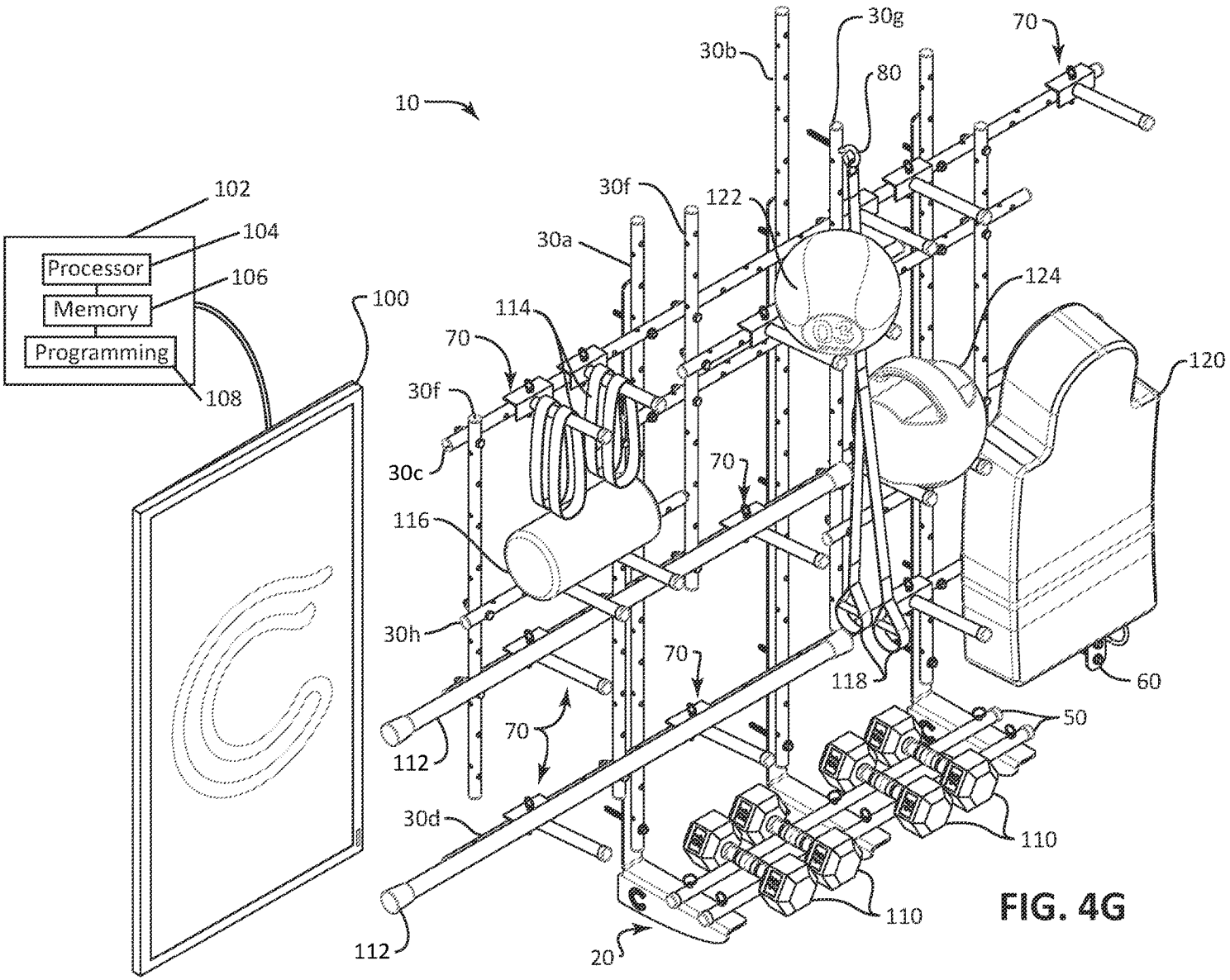
FIG. 4G is a perspective view the modular fitness system with various equipment items being housed on or otherwise coupled to the system.

FIG. 4E illustrates a perspective view of a fifth step of mounting a second set of horizontal elongate bars 30*h* in an orthogonal orientation to the second set of vertical elongate bars 30*f*, 30*g*. Fasteners in the form of bolt 40 and nut 42 are employed at each junction of the crossing elongate bars. A rectangular array (or grid) of mounding through-holes 34 is provided by the conformal spacing and orientation/mounting of horizontal elongate bars 30*h*, the array of through-holes from elongate bars 30*h* being in a plane parallel to and at a distance offset from the plane of array of through-holes from the vertical elongate bars 30*f*, 30*g*, the plane of array of through-holes from elongate bars 30*c*, 30*d*, 30*e* and the plane of array of through-holes from elongate bars 30*a*, 30*b*.

FIG. 4F illustrates a perspective view of a sixth step of mounting a pair of dumbbell support bars 50 to the L-shaped wall bars 20. Dumbbell support bars 50 are fastened to the foot plate 22 by inserting eye-ring quick release pins 52 through through-holes 28 in the foot plate 22. The dumbbell support bars 50 span across the one or more foot plates 22 to form spaced-apart parallel bars upon which a plurality of dumbbells may be held. The dumbbell support bars 50 may similarly comprise 1" round aluminum tubing with end caps, and be powder coated, painted, or anodized to have a specified color and protective layer. The holding bar assemblies 70 may also be installed during this step, by fastening them to any of the elongate bars 30*a* through 30*h* via quick release pins 52.

FIG. 4G is a perspective view the modular fitness system 10 with holding bar assemblies 70 installed at desired locations on elongate bars 30*a* through 30*h* to form "holding zones" that house and/or retain various equipment items to modular fitness system 10. For example, a pair of holding bar assemblies 70 may be horizontally spaced from each other at a relatively short distance to retain a medicine ball 122, kettle ball 124, or foam roller 116. A pair of holding bar assemblies 70 may be horizontally spaced from each other at a wider distance to retain a stretching stick 112. Additional holding bar assemblies 70 may be installed to retain other fitness devices, such as elastic bands 114 or training pad 120. Eye bolt 80 may also be located to support fixation of one end of a suspension training device such as a TRX® band or the like device. Several sets of dumbbells 110 may be aligned in an array on dumbbell support bars 50.

The system 10 may further include a display 100 which may include or be coupled to a computing device 102 having a processor 104 and application programming 108 stored on memory 106 and executable on processor for providing various real-time or stored fitness programs or videos on display 100. The application programming 108 may comprise instructions to highlight or otherwise provide visualization of various equipment items (e.g. stretch stick, medicine ball 122, etc.) to be used for an upcoming routine and how such item is to be used. Computing device 102 may be coupled to a network or Internet for communicating with one or more instructors, other users, or exercise programs.

The components and methods for assembly of modular fitness system 10 provide a simple, sound, and efficient means for providing a platform for forging holding 'zones' for numerous different pieces of equipment, particularly through the one or more arrays of bar through-holes 32/34 of elongate bars 30*a*-30*h* and wall through-holes 26 in dumbbell support assemblies 50. The system can continuously and easily be modified to accommodate different or additional fitness equipment, or adapt to a changing in the environment in which is installed, by reorienting/adding/changing one or more of the elongate bars 30*a*-30*h* and/or reorienting/adding/changing one or more of the holding bar assemblies 70 anywhere on the formed sculpture to house various equipment pieces in whatever pattern or manner desired by the user.

In sum, the components and methods for assembly of modular fitness system 10 disclosed herein provide an aesthetic, "art-like" sculpture forming a fitness/exercise system that is adaptive to its environment and user, all while minimizing space and maximizing the function of the room or area it occupies.

From the description herein, it will be appreciated that that the present disclosure encompasses multiple embodiments which include, but are not limited to, the following:

1. A modular fitness system comprising: a set of at least two spaced-apart elongate wall bars configured to be secured to a vertical structure at spaced apart locations on the vertical structure and at a substantially vertical orientation on a planar surface of the vertical structure; each wall bar having a linear array of wall through-holes incrementally disposed along the length of the wall bar for attaching the wall bar to the vertical structure via a fastener; a first set of at least two horizontal elongate bars configured to be installed on top of and orthogonal to the wall bars to form a cross or T with the wall bars; wherein each of the horizontal elongate bars comprises a first linear array of bar through-holes spaced at increments along a length of the elongate bar that match at least a portion of the linear array of wall through-holes when secured to the vertical structure; and wherein the linear arrays of bar through-holes in the horizontal elongate bars, when secured to the set of wall bars, form a first rectangular array of equally spaced through-holes in a plane parallel to and offset from the planar surface of the vertical structure, the first rectangular array having individual through-hole axes perpendicular to the mounting surface for providing locations for attachment of one or more of an additional set of elongate bars and one or more components for holding fitness equipment.

2. The modular fitness system or method of any of the subsequent or preceding embodiments, wherein the horizontal elongate bars each comprise a second linear array of bar through-holes orthogonal to the first linear array, wherein upon mounting, the horizontal elongate bars the second linear array of through-holes are disposed with their individual axes parallel to the mounting surface of the vertical structure.

3. The modular fitness system or method of any of the subsequent or preceding embodiments, wherein each of the wall bars comprise: an elongate wall plate through which the linear array of wall through-holes are disposed; a foot plate extending from the elongate wall plate to form an L-shaped wall bar; wherein the foot plate extends horizontally from the elongate wall plate when mounted to the vertical structure to support placement of a plurality of dumbbells on the fitness system.

4. The modular fitness system or method of any of the subsequent or preceding embodiments, wherein the foot plate comprises a pair of foot through-holes for providing attachment of a pair of dumbbell support bars horizontally disposed across the plurality of wall bars when secured to the vertical structure, the dumbbell support bars providing a pair of spaced-apart parallel bars for holding the plurality of dumbbells.

5. The modular fitness system or method of any of the subsequent or preceding embodiments, further comprising a holding bar for holding a piece of fitness equipment, the holding bar comprising: a bracket sized for spanning across a portion of one of the horizontal elongate bars, the bracket having a first flange configured to rest on an upper surface of the horizontal elongate bar and a second flange orthogonal to the first flange; a rod having a proximal end attached to the second flange and a distal end extending outward at an angle with respect to the second flange such that the rod, when attached to the horizontal elongate bar, has an upward slope from the proximal end to the distal end; wherein the first flange of the bracket comprises a flange through-hole for securing the holding bar to the horizontal elongate bar via placement of a releasable pin through the flange through-hole and one of the through-holes in the second linear array of bar through-holes.

6. The modular fitness system or method of any of the subsequent or preceding embodiments, further comprising a pair of holding bars disposed on the horizontal elongate bar and spaced in relation to each other to form a platform for holding a piece of fitness equipment.

7. The modular fitness system or method of any of the subsequent or preceding embodiments, further comprising first a set of vertical elongate bars configured to each be installed on top of and aligned with a respective wall bar, each of the vertical elongate bars having a first linear array of through-holes spaced at increments along a length of the elongate vertical bar that match at least a portion of the linear array of through-holes in the set of wall bars; wherein the first set of horizontal elongate bars are secured on top of the first set of vertical elongate bars via insertion of a fastener through one of the through-holes in the first linear array of through-holes in the vertical elongate bar in addition to a through-hole of the array of wall through-holes in the wall bar.

8. The modular fitness system or method of any of the subsequent or preceding embodiments, further comprising: a second set of vertical elongate bars configured to be installed on top of and orthogonal to the first set of horizontal elongate bars to form a T with respective horizontal elongate bars; wherein each of the second set of vertical elongate bars comprises a first linear array of through-holes spaced at increments along a length of the elongate bar that match at least a portion of the first rectangular array of through-holes in the horizontal elongate bars to allow attachment of the second set of vertical elongate bars to the first set of horizontal elongate bars; and wherein the second set of vertical elongate bars, when secured to the first set of horizontal elongate bars, form a second rectangular array of equally spaced holes in a plane parallel to and offset from the first rectangular array and the planar surface of the vertical structure, the second rectangular array having individual through-hole axes perpendicular to the mounting surface for providing additional locations for attachment of one or more of an additional set of elongate bars or one or more components for holding fitness equipment.

9. The modular fitness system or method of any of the subsequent or preceding embodiments, further comprising: a second set of horizontal elongate bars configured to be installed on top of and orthogonal to the second set of vertical elongate bars to form a cross or T with respective vertical elongate bars; wherein each of the second set of horizontal elongate bars comprises a first linear array of through-holes spaced at increments along a length of the elongate bar that match at least a portion of the second rectangular array of through-holes in the second set of vertical elongate bars to allow attachment of the second set of horizontal elongate bars to the second set of vertical elongate bars; and wherein the second set of horizontal elongate bars, when secured to the second set of vertical elongate bars, forms a third rectangular array of equally spaced holes in a plane parallel to and offset from the second rectangular array and the planar surface of the vertical structure, the third rectangular array having individual through-hole axes perpendicular to the mounting surface for additional locations for attachment of one or more of an additional set of elongate bars or one or more components for holding fitness equipment.

10. The modular fitness system or method of any of the subsequent or preceding embodiments, wherein the horizontal elongate bars and vertical elongate bars each comprise a second linear array of through-holes orthogonal to the first linear array, wherein upon mounting the horizontal elongate bars the second linear array of through-holes are disposed with their individual axes parallel to the mounting surface of the vertical structure.

11. The modular fitness system or method of any of the subsequent or preceding embodiments, further comprising: a display mounted to the vertical structure in proximity to the set of wall bars; a processor in communication with the display; memory; and application programming stored on the memory and executable on the processor for providing various real-time or stored fitness programs or videos on the display; the application programming further comprising instructions to highlight or provide visualization of various equipment items held on the modular fitness system.

12. A method for holding one or more pieces of fitness equipment, comprising: positioning a set of at least two spaced-apart elongate wall bars to a vertical structure at spaced-apart locations on a planar surface of the vertical structure and at a substantially vertical orientation on the planar surface; wherein each wall bar comprises a linear array of wall through-holes incrementally disposed along the length of the wall bar; positioning a first set of at least two horizontal elongate bars on top of and orthogonal to the wall bars to form a cross or T with the wall bars; wherein each of the horizontal elongate bars comprises a first linear array of through-holes spaced at increments along a length of the elongate bar that match at least a portion of the linear array of through-holes in the set of wall bars when secured to the vertical structure; wherein the horizontal elongate bars, when secured to the set of wall bars, form a first rectangular array of equally spaced holes in a plane parallel to and offset from the planar surface of the vertical structure, the first rectangular array having individual through-hole axes perpendicular to the mounting surface for providing locations for attachment of one or more of an additional set of elongate bars or one or more components for holding fitness equipment; and securing each of the horizontal elongate bars to the vertical structure by insertion of a fastener through a through-hole in the first rectangular array and a corresponding wall through-hole of a respective wall bar.

13. The modular fitness system or method of any of the subsequent or preceding embodiments, wherein the horizontal elongate bars each comprise a second linear array of bar through-holes orthogonal to the first linear array, and wherein upon mounting, the horizontal elongate bars the second linear array of through-holes are disposed with their individual axes parallel to the mounting surface of the vertical structure, the method further comprising: positioning a component to a horizontal elongate bar within the first set of horizontal elongate bars; and attaching the component to the horizontal elongate bar by insertion of a quick-release pin fastener through a through-hole of the second linear array of through-holes.

14. The modular fitness system or method of any of the subsequent or preceding embodiments, wherein each of the wall bars comprise an elongate wall plate through which the linear array of wall through-holes are disposed and a foot plate extending from the elongate wall plate to form an L-shaped wall bar, wherein the foot plate extends horizontally from the elongate wall plate when mounted to the vertical structure, the method further comprising: supporting placement of a plurality of dumbbells on the foot plates.

15. The modular fitness system or method of any of the subsequent or preceding embodiments, wherein the foot plate comprises a pair of foot through-holes, the method further comprising: attaching a pair of dumbbell support bars horizontally across the plurality of wall bars to form spaced-apart parallel bars; and holding the plurality of dumbbells on the pair of dumbbell support bars.

16. The modular fitness system or method of any of the subsequent or preceding embodiments, further comprising: coupling a first holding bar to one of the horizontal elongate bars: the first holding bar comprising a bracket sized for spanning across a portion of the horizontal elongate bar, the bracket having a first flange configured to rest on an upper surface of the horizontal elongate bar and a second flange orthogonal to the first flange, and a rod having a proximal end attached to the second flange and a distal end extending outward at an angle with respect to the second flange such that the rod, fastening the bracket to the horizontal elongate bar by insertion of the quick-release pin fastener through a through-hole in the first flange and one of the through-holes in the second linear array of bar through-holes wherein upon fastening to the horizontal elongate bar, the rod has an upward slope from the proximal end to the distal end to promote holding one or more pieces of fitness equipment.

17. The modular fitness system or method of any of the subsequent or preceding embodiments, further comprising: securing a second holding bar on the horizontal elongate bar at a spaced-apart location from the first holding bar to form a platform for holding the piece of fitness equipment.

18. The modular fitness system or method of any of the subsequent or preceding embodiments, further comprising: installing first a set of vertical elongate bars on top of and aligned with a respective wall, each of the vertical elongate bars having a first linear array of through-holes spaced at increments along a length of the elongate vertical bar that match at least a portion of the linear array of through-holes in the set of wall bars; securing the first set of horizontal elongate bars on top of the first set of vertical elongate bars via insertion of a fastener through one of the through-holes in the first linear array of through-holes in the vertical elongate bar in addition to a through-hole of the array of wall through-holes in the wall bar.

19. The modular fitness system or method of any of the subsequent or preceding embodiments, further comprising: positioning a second set of vertical elongate bars on top of and orthogonal to the first set of horizontal elongate bars to form a cross or T with respective horizontal elongate bars; wherein each of the second set of vertical elongate bars comprises a first linear array of through-holes spaced at increments along a length of the elongate bar that match at least a portion of the first rectangular array of through-holes in the horizontal elongate bars; and securing the second set of vertical elongate bars to the first set of horizontal elongate bars by fastening through one or more through-holes in the first rectangular array of through-holes in the horizontal elongate bars and one or more through-holes in the first linear array of through-holes in the second set of vertical elongate bars; and wherein the second set of vertical elongate bars, when secured to the first set of horizontal elongate bars, form a second rectangular array of equally spaced holes in a plane parallel to and offset from the first rectangular array and the planar surface of the vertical structure, the second rectangular array having individual through-hole axes perpendicular to the mounting surface for providing additional locations for attachment of one or more of an additional set of elongate bars or one or more components for holding fitness equipment.

20. The modular fitness system or method of any of the subsequent or preceding embodiments, further comprising: positioning a second set of horizontal elongate bars on top of and orthogonal to the second set of vertical elongate bars to form a cross or T with respective vertical elongate bars; wherein each of the second set of horizontal elongate bars comprises a first linear array of through-holes spaced at increments along a length of the elongate bar that match at least a portion of the second rectangular array of through-holes in the second set of vertical elongate bars; and securing the second set of horizontal elongate bars to the second set of vertical elongate bars by fastening through one or more through-holes in the second rectangular array of through-holes in the second set of vertical elongate bars and one or more through-holes in the first linear array of through-holes in the second set of horizontal elongate bars; and wherein the second set of horizontal elongate bars, when secured to the second set of vertical elongate bars, forms a third rectangular array of equally spaced holes in a plane parallel to and offset from the second rectangular array and the planar surface of the vertical structure, the third rectangular array having individual through-hole axes perpendicular to the mounting surface for additional locations for attachment of one or more of an additional set of elongate bars or one or more components for holding fitness equipment.

21. The modular fitness system or method of any of the subsequent or preceding embodiments, wherein the horizontal elongate bars and vertical elongate bars each comprise a second linear array of through-holes orthogonal to the first linear array, wherein upon mounting the horizontal elongate bars the second linear array of through-holes are disposed with their individual axes parallel to the mounting surface of the vertical structure.

22. The modular fitness system or method of any of the subsequent or preceding embodiments, further comprising: mounting a display mounted to the vertical structure in proximity to the set of wall bars; providing various real-time or stored fitness programs or videos on the display; and providing visualization on the display of various equipment items held on the modular fitness system.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural, chemical, and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

In addition to any other claims, the applicant(s)/inventor(s) claim each and every embodiment of the technology described herein, as well as any aspect, component, or element of any embodiment described herein, and any combination of aspects, components or elements of any embodiment described herein.

Elements, characteristics, or acts from one embodiment can be readily recombined or substituted with one or more elements, characteristics or acts from other embodiments to form numerous additional embodiments within the scope of the technology of the present disclosure. Moreover, elements that are shown or described as being combined with other elements, can, in various embodiments, exist as standalone elements. Hence, the scope of the present technology of the present disclosure is not limited to the specifics of the described embodiments, but is instead limited solely by the appended claims.

Embodiments of the present technology may be described herein with reference to flowchart or block-diagram illustrations of methods and systems according to embodiments of the technology, and/or procedures, algorithms, steps, operations, formulae, or other computational depictions, which may also be implemented as computer software or programming. The terms "programming" or "program executable" as used herein refer to one or more instructions that can be executed by one or more computer processors to perform one or more functions as described herein. The instructions can be embodied in software, in firmware, or in a combination of software and firmware. The instructions can be stored local to the device in non-transitory media, or can be stored remotely such as on a server, or all or a portion of the instructions can be stored locally and remotely. Instructions stored remotely can be downloaded (pushed) to the device by user initiation, or automatically based on one or more factors.

It will further be appreciated that as used herein, that the terms processor, computer processor, central processing unit (CPU), and computer are used synonymously to denote a device capable of executing the instructions and communicating with input/output interfaces and/or peripheral devices, and that the terms processor, computer processor, CPU, and computer are intended to encompass single or multiple devices, and variations thereof.

What is claimed is:

1. A modular fitness system, comprising:

a set of at least two spaced-apart elongate wall bars configured to be secured to a vertical structure at spaced apart locations on the vertical structure and at a substantially vertical orientation on a planar surface of the vertical structure;

each wall bar having a linear array of wall through-holes incrementally disposed along a length of the wall bar for attaching the wall bar to the vertical structure via a fastener;

a first set of at least two horizontal elongate bars configured to be installed on top of and orthogonal to the wall bars to form a cross or T with the wall bars;

wherein each of the horizontal elongate bars comprises a first linear array of bar through-holes spaced at increments along a length of the elongate bar that match at least a portion of the linear array of wall through-holes when secured to the vertical structure; and wherein the linear arrays of bar through-holes in the horizontal elongate bars, when secured to the set of wall bars, form a first rectangular array of equally spaced through-holes in a plane parallel to and offset from the planar surface of the vertical structure, the first rectangular array having individual through-hole axes perpendicular to the planar surface for providing locations for attachment of one or more of an additional set of elongate bars and one or more components for holding fitness equipment.

2. The modular fitness system of claim 1, wherein the horizontal elongate bars each comprise a second linear array of bar through-holes orthogonal to the first linear array, wherein upon mounting, the horizontal elongate bars the second linear array of through-holes are disposed with their individual axes parallel to the mounting surface of the vertical structure.

3. The modular fitness system of claim 1, wherein each of the wall bars comprise:

an elongate wall plate through which the linear array of wall through-holes are disposed; and a foot plate extending from the elongate wall plate to form an L-shaped wall bar;

wherein the foot plate extends horizontally from the elongate wall plate when mounted to the vertical structure to support placement of a plurality of dumbbells on the fitness system.

4. The modular fitness system of claim 3, wherein the foot plate comprises a pair of foot through-holes for providing attachment of a pair of dumbbell support bars horizontally disposed across the L-shaped wall bars when secured to the vertical structure, the dumbbell support bars providing a pair of spaced-apart parallel bars for holding the plurality of dumbbells.

5. The modular fitness system of claim 2, further comprising a holding bar for holding a piece of fitness equipment, the holding bar comprising:

a bracket sized for spanning across a portion of one of the horizontal elongate bars, the bracket having a first flange configured to rest on an upper surface of the horizontal elongate bar and a second flange orthogonal to the first flange; and a rod having a proximal end attached to the second flange and a distal end extending outward at an angle with respect to the second flange such that the rod, when attached to the horizontal elongate bar, has an upward slope from the proximal end to the distal end;

wherein the first flange of the bracket comprises a flange through-hole for securing the holding bar to the horizontal elongate bar via placement of a releasable pin through the flange through-hole and one of the through-holes in the second linear array of bar through-holes.

6. The modular fitness system of claim 5, further comprising a pair of holding bars disposed on the horizontal elongate bar and spaced in relation to each other to form a platform for holding a piece of fitness equipment.

7. The modular fitness system of claim 1, further comprising first a set of vertical elongate bars configured to each be installed on top of and aligned with a respective wall bar, each of the vertical elongate bars having a first linear array of through-holes spaced at increments along a length of the elongate vertical bar that match at least a portion of the linear array of through-holes in the set of wall bars; and wherein the first set of horizontal elongate bars are secured on top of the first set of vertical elongate bars via insertion of a fastener through one of the through-holes in the first linear array of through-holes in the vertical elongate bar in addition to a through-hole of the array of wall through-holes in the wall bar.

8. The modular fitness system of claim 6, further comprising:

a second set of vertical elongate bars configured to be installed on top of and orthogonal to the first set of horizontal elongate bars to form a cross or T with respective horizontal elongate bars;

wherein each of the second set of vertical elongate bars comprises a first linear array of through-holes spaced at increments along a length of the elongate bar that match at least a portion of the first rectangular array of through-holes in the horizontal elongate bars to allow attachment of the second set of vertical elongate bars to the first set of horizontal elongate bars; and wherein the second set of vertical elongate bars, when secured to the first set of horizontal elongate bars, form a second rectangular array of equally spaced holes in a plane parallel to and offset from the first rectangular array and the planar surface of the vertical structure, the second rectangular array having individual through-hole axes perpendicular to the mounting surface for providing additional locations for attachment of one or more of an additional set of elongate bars or one or more components for holding fitness equipment.

9. The modular fitness system of claim 8, further comprising:

a second set of horizontal elongate bars configured to be installed on top of and orthogonal to the second set of vertical elongate bars to form a cross or T with respective vertical elongate bars;

wherein each of the second set of horizontal elongate bars comprises a first linear array of through-holes spaced at increments along a length of the elongate bar that match at least a portion of the second rectangular array of holes in the second set of vertical elongate bars to allow attachment of the second set of horizontal elongate bars to the second set of vertical elongate bars; and wherein the second set of horizontal elongate bars, when secured to the second set of vertical elongate bars, forms a third rectangular array of equally spaced holes in a plane parallel to and offset from the second rectangular array and the planar surface of the vertical structure, the third rectangular array having individual through-hole axes perpendicular to the mounting surface for additional locations for attachment of one or more of an additional set of elongate bars or one or more components for holding fitness equipment.

10. The modular fitness system of any of claim 3, wherein the horizontal elongate bars and vertical elongate bars each comprise a second linear array of through-holes orthogonal to the first linear array, wherein upon mounting the horizontal elongate bars the second linear array of through-holes are disposed with their individual axes parallel to the mounting surface of the vertical structure.

11. The modular fitness system of claim 1, further comprising:

a display mounted to the vertical structure in proximity to the set of wall bars;

a processor in communication with the display;

memory; and application programming stored on the memory and executable on the processor for providing various real-time or stored fitness programs or videos on the display;

the application programming further comprising instructions to highlight or provide visualization of various equipment items held on the modular fitness system.

12. A method for holding one or more pieces of fitness equipment, comprising:

positioning a set of at least two spaced-apart elongate wall bars to a vertical structure at spaced-apart locations on a planar surface of the vertical structure and at a substantially vertical orientation on the planar surface;

wherein each wall bar comprises a linear array of wall through-holes incrementally disposed along a length of the wall bar;

positioning a first set of at least two horizontal elongate bars on top of and orthogonal to the wall bars to form a cross or T with the wall bars;

wherein each of the horizontal elongate bars comprises a first linear array of through-holes spaced at increments along a length of the elongate bar that match at least a portion of the linear array of through-holes in the set of wall bars when secured to the vertical structure;

wherein the horizontal elongate bars, when secured to the set of wall bars, form a first rectangular array of equally spaced holes in a plane parallel to and offset from the planar surface of the vertical structure, the first rectangular array having individual through-hole axes perpendicular to the planar surface for providing locations for attachment of one or more of an additional set of elongate bars or one or more components for holding fitness equipment; and securing each of the horizontal elongate bars to the vertical structure by insertion of a fastener through a through-hole in the first rectangular array and a corresponding wall through-hole of a respective wall bar.

13. The method of claim 12, wherein the horizontal elongate bars each comprise a second linear array of bar through-holes orthogonal to the first linear array, and wherein upon mounting, the horizontal elongate bars the second linear array of through-holes are disposed with their individual axes parallel to the mounting surface of the vertical structure, the method further comprising:

positioning a component to a horizontal elongate bar within the first set of horizontal elongate bars; and attaching the component to the horizontal elongate bar by insertion of a quick-release pin fastener through a through-hole of the second linear array of through-holes.

14. The method of claim 12, wherein each of the wall bars comprise an elongate wall plate through which the linear array of wall through-holes are disposed and a foot plate extending from the elongate wall plate to form an L-shaped wall bar, wherein the foot plate extends horizontally from the elongate wall plate when mounted to the vertical structure, the method further comprising:

supporting placement of a plurality of dumbbells on the foot plates.

15. The method of claim 14, wherein the foot plate comprises a pair of foot through-holes, the method further comprising:

attaching a pair of dumbbell support bars horizontally across the L-shaped wall bars to form spaced-apart parallel bars; and holding the plurality of dumbbells on the pair of dumbbell support bars.

16. The method of claim 13, further comprising:

coupling a first holding bar to one of the horizontal elongate bars;

wherein the first holding bar comprises a bracket sized for spanning across a portion of the horizontal elongate bar, the bracket having a first flange configured to rest on an upper surface of the horizontal elongate bar and a second flange orthogonal to the first flange, and a rod having a proximal end attached to the second flange and a distal end extending outward at an angle with respect to the second flange such that the rod; and fastening the bracket to the horizontal elongate bar by insertion of the quick-release pin fastener through a through-hole in the first flange and one of the through-holes in the second linear array of bar through-holes;

wherein upon fastening to the horizontal elongate bar, the rod has an upward slope from the proximal end to the distal end to promote holding one or more pieces of fitness equipment.

17. The method of claim 16, further comprising:

securing a second holding bar on the horizontal elongate bar at a spaced-apart location from the first holding bar to form a platform for holding the piece of fitness equipment.

18. The method of claim 12, further comprising:

installing first a set of vertical elongate bars on top of and aligned with a respective wall, each of the vertical elongate bars having a first linear array of through-holes spaced at increments along a length of the elongate vertical bar that match at least a portion of the linear array of through-holes in the set of wall bars; and securing the first set of horizontal elongate bars on top of the first set of vertical elongate bars via insertion of a fastener through one of the through-holes in the first linear array of through-holes in the vertical elongate bar in addition to a through-hole of the array of wall through-holes in the wall bar.

19. The method of claim 18, further comprising:

positioning a second set of vertical elongate bars on top of and orthogonal to the first set of horizontal elongate bars to form a cross or T with respective horizontal elongate bars;

wherein each of the second set of vertical elongate bars comprises a first linear array of through-holes spaced at increments along a length of the elongate bar that match at least a portion of the first rectangular array of through-holes in the horizontal elongate bars; and securing the second set of vertical elongate bars to the first set of horizontal elongate bars by fastening through one or more through-holes in the first rectangular array of through-holes in the horizontal elongate bars and one or more through-holes in the first linear array of through-holes in the second set of vertical elongate bars; and wherein the second set of vertical elongate bars, when secured to the first set of horizontal elongate bars, form a second rectangular array of equally spaced holes in a plane parallel to and offset from the first rectangular array and the planar surface of the vertical structure, the second rectangular array having individual through-hole axes perpendicular to the planar surface for providing additional locations for attachment of one or more of an additional set of elongate bars or one or more components for holding fitness equipment.

20. The method of claim 19, further comprising:

positioning a second set of horizontal elongate bars on top of and orthogonal to the second set of vertical elongate bars to form a cross or T with respective vertical elongate bars;

wherein each of the second set of horizontal elongate bars comprises a first linear array of through-holes spaced at increments along a length of the elongate bar that match at least a portion of the second rectangular array of holes in the second set of vertical elongate bars; and securing the second set of horizontal elongate bars to the second set of vertical elongate bars by fastening through one or more through-holes in the second rectangular array of holes in the second set of vertical elongate bars and one or more through-holes in the first linear array of through-holes in the second set of horizontal elongate bars;

wherein the second set of horizontal elongate bars, when secured to the second set of vertical elongate bars, forms a third rectangular array of equally spaced holes in a plane parallel to and offset from the second rectangular array and the planar surface of the vertical structure, the third rectangular array having individual through-hole axes perpendicular to the planar surface for additional locations for attachment of one or more of an additional set of elongate bars or one or more components for holding fitness equipment.

21. The method of claim 14, wherein the horizontal elongate bars and vertical elongate bars each comprise a second linear array of through-holes orthogonal to the first linear array, wherein upon mounting the horizontal elongate bars the second linear array of through-holes are disposed with their individual axes parallel to the mounting surface of the vertical structure.

22. The method of claim 12, further comprising:

mounting a display mounted to the vertical structure in proximity to the set of wall bars;

providing various real-time or stored fitness programs or videos on the display; and providing visualization on the display of various equipment items held on any of the elongate bars.

* * * * *